US005492230A

United States Patent [19]

Horton

[11] Patent Number: 5,492,230

[45] Date of Patent: Feb. 20, 1996

[54] COLLAPSIBLE GOLF CLUB STAND

[76] Inventor: Russell B. Horton, 14 Drumcastle Ct., Germantown, Md. 20876

[21] Appl. No.: 307,231

[22] Filed: Sep. 16, 1994

[51] Int. Cl.[6] ..... A47F 7/00

[52] U.S. Cl. ..... 211/70.2; 211/196; 248/528; 273/32 E

[58] Field of Search ..... 211/70.2, 196; 248/511, 528; 273/80 R, 32 E, 32 B

[56] References Cited

U.S. PATENT DOCUMENTS

| | | | |
|---|---|---|---|
| 4,616,749 | 10/1986 | Briggs | 273/328 X |
| 4,832,338 | 5/1989 | Magazzi | 273/32 E X |
| 5,080,239 | 1/1992 | Rowland | 211/70.2 |
| 5,127,530 | 7/1992 | Ortuno | 211/70.2 |
| 5,230,507 | 7/1993 | White et al. | 211/70.2 X |
| 5,413,329 | 5/1995 | Hirsch | 211/70.2 X |

FOREIGN PATENT DOCUMENTS

| | | | |
|---|---|---|---|
| 845850 | 8/1952 | Germany | 248/528 |

*Primary Examiner*—Robert W. Gibson, Jr.
*Attorney, Agent, or Firm*—Steven M. Rabin

[57] ABSTRACT

A golf club stand including a collapsible pair of legs having a lower ground engaging end and an upper end, and a golf club shaft engaging member connected to the upper end of the pair of legs. The shaft engaging member releasably engages the golf club shaft, such that the golf club is held in a generally upright position with the head of the golf club and the lower ends of the pair of legs engaging the ground. The legs are pivotally connected to each other at their upper end so as to permit them to be collapsed into a compact state for carrying. The legs may be collapsed further by forming each leg in a telescoping manner. The shaft engaging member includes a support portion having a generally U-shaped groove into which the lower end of the shaft of the club may be inserted. The shaft engaging member may also include a base or grip portion to which the legs are pivotally mounted or it may be formed integrally with the upper end of one of the legs.

16 Claims, 4 Drawing Sheets

COLLAPSIBLE GOLF CLUB STAND

FIELD OF THE INVENTION

The invention relates to a golf club stand, and more particularly, to a stand for a golf club which in use props up a golf club, and when not in use can be collapsed for storage.

BACKGROUND OF THE INVENTION

Golf is a sport of extreme popularity in the United States and throughout the world for persons of all ages and physical capabilities. To speed up play, and increase enjoyment of the participants, electric or gasoline powered golf carts and manual pull carts are commonly used to carry a bag of golf clubs around the golf course. However, it is often necessary for a golfer to walk to his ball for a shot at a location where golf carts and pull carts are not permitted for the sake of protecting the golf course from damage. For example, on some golf courses, and particularly when the ground is wet as from rain, golf carts are restricted to specially constructed cart paths. Moreover, both golf carts and pull carts are never permitted on and in the immediate vicinity of the green.

In such circumstances, a golfer often leaves his or her cart and carries two golf clubs to the ball. This may be done for a variety of reasons. For example, the golfer may be uncertain which one of two clubs to use for the next shot. Alternatively, the golfer may want to use one club for a first shot, and then walk directly to the ball at its new location with the expectation of using the second club for a second shot. This happens most frequently when the first shot is short shot to the green so that the second shot will be a putt. In such a case, the golfer would carry both a wedge and a putter.

When a golfer carries two clubs, the golfer must of course lay down the unused club when playing a shot with the other club. Laying a club down can have several disadvantages. The golfer must bend over to pick the club up, which may be painful for persons with back injuries. If the ground is wet, the handle will become wet and therefore must be dried off before a shot may be hit with that club. A club laying on the ground is not easily seen, so that it may be left behind if the golfer does not remember to pick it up.

Golf club stands to prop up the unused golf club are known. However, known golf club stands suffer from a number of disadvantages. U.S. Pat. Nos. 5, 116,046 (Pace) and 4,838,285 (Petrone) discloses golfer's tools having multiple uses. Each has one end adapted to penetrate the ground and a second end adapted to grip or support the top end of the shaft of the golf club. These tools have the disadvantage that they lift the club grip only a few inches from the ground. While each tool prevents the grip from becoming wet, the club is almost prone so that the golfer must bend down almost to the ground to pick up the club and tool. Moreover, the club is not easily seen, so that the club is easily forgotten and left behind.

U.S. Pat. Nos.5,285,990 (Engel), 5,127,530 (Ortuno) and 2,887, 137 (Robb) disclose golf club stands which are elongated (of comparable length to that of a golf club) and stick into the ground. Such golf stands are cumbersome to carry and must be retained in and removed from the golf bag respectively between and for use. Moreover such club stands may be unstable in supporting a golf club, depending on the ground condition.

U.S. Pat. No. 5,230,507 (White et al) discloses a golf stand which engages the golf club shaft near the hosel and forms together with the clubhead a three-point support for the club, with the club held generally upright. This device is bulky so that it is not easily carried by the golfer. When not in use it must be carried in the golfer's hand, laid on the ground, carried on the cart or attached to the golf bag. Moreover, attachment of the device to the golf bag by a clip may require a clip specially designed for the particular bag design. Further, most golf bags have a handle, a carry strap, and many exterior pockets for storing various items, such as golf ball and tees, rainwear, etc. The locations of the strap and handle may interfere with attachment of the device by its clip. When the golf stand is attached to the bag, it may interfere with access to one or more of the golf bag's pockets.

SUMMARY OF THE INVENTION

It is therefore an object of the invention to provide a lightweight, low-cost golf club stand that overcomes the disadvantages of the prior golf stands described above, that is readily carried on the golfer's person without interfering with his play, and that easily attaches to a golf club shaft and supports the golf club in a generally upright position.

According to the invention, there is provided a golf club stand which has a collapsible pair of legs having a lower ground engaging end and an upper end, and a golf club shaft engaging member connected to the upper end of the pair of legs. The shaft engaging member releasably engages the golf club shaft, such that the golf club is held in a generally upright position with the head of the golf club and the lower ends of the pair of legs engaging the ground. The legs are pivotally connected to each other at their upper end so as to permit them to be collapsed into a compact state for carrying. The legs may be collapsed further by forming each leg in a telescoping manner. The shaft engaging member includes a support portion having a generally U-shaped groove into which the lower end of the shaft of the club may be inserted. The shaft engaging member may also include a base portion to which the legs are pivotally mounted or it may be formed integrally with the upper end of one of the legs.

In its collapsed state, the stand has a generally tubular shape, between approximately one half inch and one inch in diameter, with a bend at one end. In some embodiments the bend is defined by the direction of the groove in the shaft engaging member. The bend is typically about 45 degree to provide proper angulation of the club when supported by the stand. The length of the angled shaft engaging member is typically about 2 inches and the overall tip-to-tip length of the collapsed stand typically is about eight inches. The collapsed stand is therefore easily and comfortably retained in the golfer's pant pocket when not in use.

In use the lower end of the club shaft is snapped into the groove, the legs are pivotally separated, and the attached club and stand are placed on the ground with the head of the club and the pivotally separated legs of the stand resting on the ground with the club extending in a generally vertical direction. When the golfer is ready to leave with the club and stand, he has merely to lift the club by its grip, detach its shaft from the shaft engaging member of the stand, pivotally collapse the stand, place the collapsed stand in his pant pocket, and move on to his next shot or his golf cart.

BRIEF DESCRIPTION OF THE DRAWINGS

These and other features and advantages of the invention will be more clearly apparent from the following detailed description of the preferred embodiments wherein.

DESCRIPTION OF THE PREFERRED EMBODIMENTS

Figure 1:
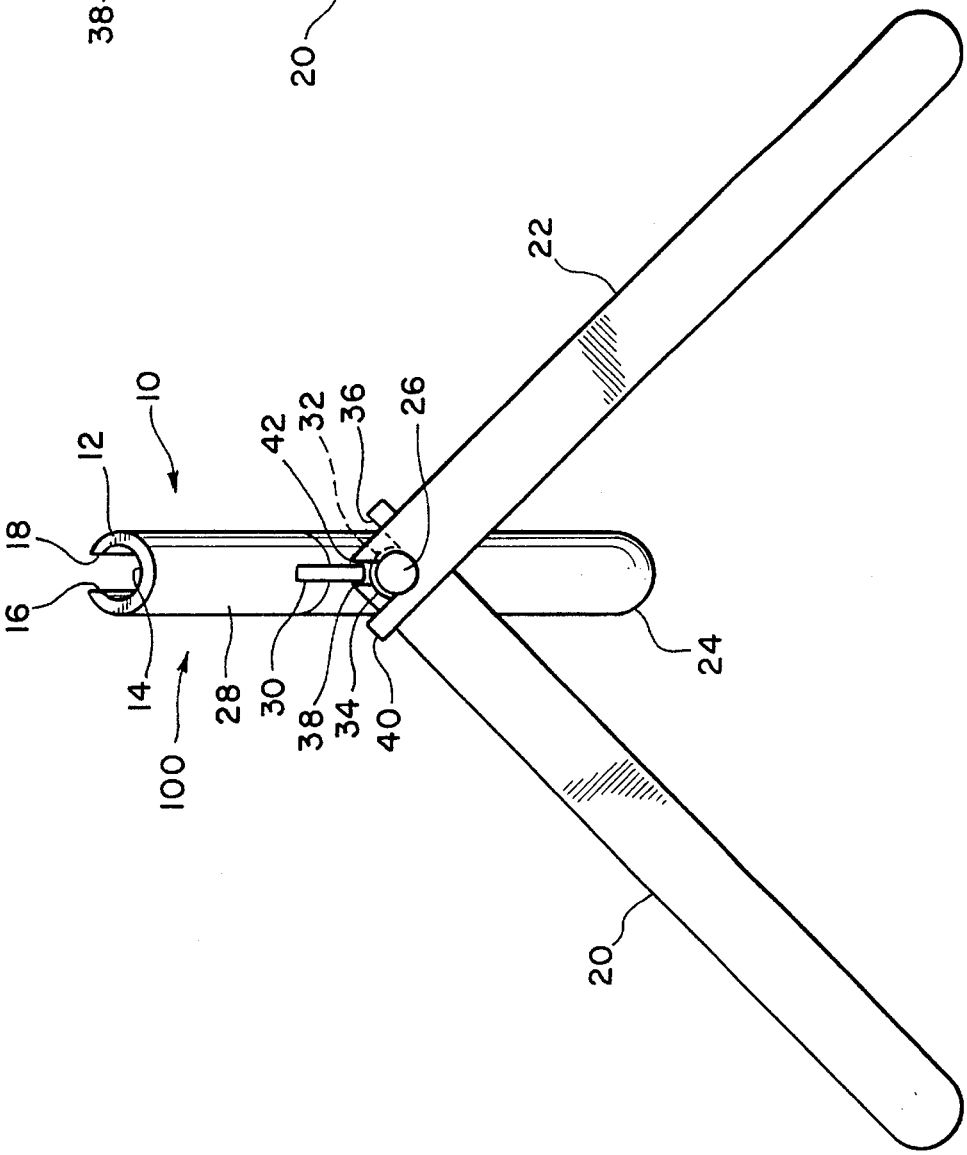
FIG. 1 is a front view of a first embodiment of the golf club stand of the invention in an open position.
Figure 6:
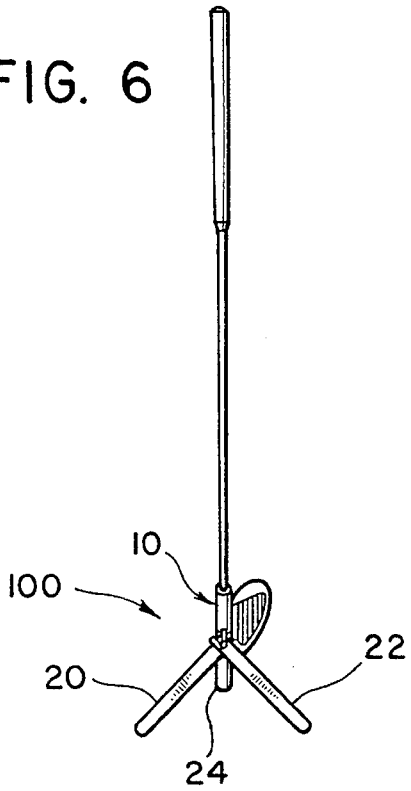
FIG. 6 is a front perspective view of the first embodiment supporting a golf club.
Figure 7:
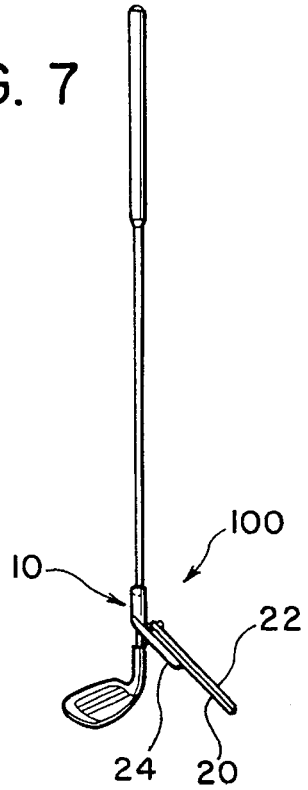
FIG. 7 is a side perspective view of the first embodiment supporting the golf club.

Referring first to FIG. 1, a golf club stand 100 according to a first preferred embodiment of the invention includes a golf club shaft engaging member 10. A pair of legs 20 and 22 for engaging the ground at their lower ends, are pivotally connected at their upper ends to the member 10. As will be explained in greater detail below, the shaft engaging member is adapted for releasably engaging the lower end of the shaft of a golf club, such that the golf club is held in a generally upright position with the golf club head and the lower ends of the pair of legs engaging the ground as illustrated in FIGS. 6 and 7.

The shaft engaging member 10 has a support portion which is provided by a resilient, generally tubular wall 12 that defines a shaft receiving recess 14 which is generally U-shaped in cross section. On a side 16 of the member 10 is provided an opening 18 in the wall 12 which accesses the recess 14. The opening 18 is slightly narrower than the diameter of the golf club shaft so that the shaft can be snapped into place in the recess 14 and withdrawn therefrom, with moderate force. At its bottom, the recess 14 has a circular arc-shaped cross section whose diameter (about three eighths of an inch) corresponds to that of the diameter of the golf club shaft at its lower end near the hosel. The recess 14 may be slightly tapered corresponding to the slight taper present in most golf club shafts.

Figure 4:
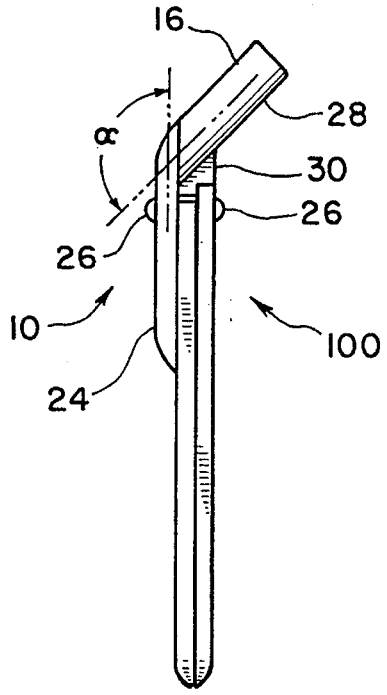
FIG. 4 is a side view of the first embodiment in a closed position.
Figure 5:
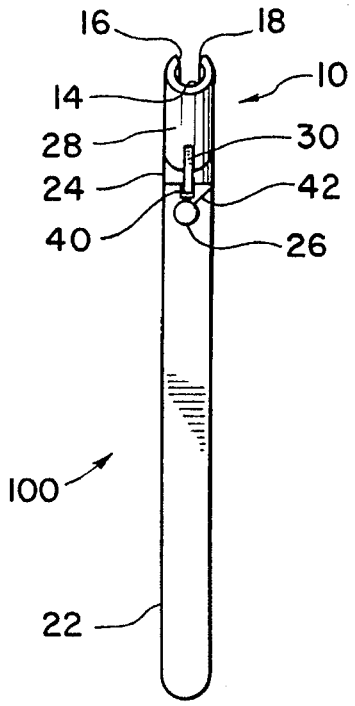
FIG. 5 is a front view of the first embodiment in the closed position.

The shaft engaging member 10 also has a depending grip portion 24 projecting downward from a bottom end of the tubular wall 12 at an angle $\alpha$ of about 135°, as best shown in FIG. 4. Legs 20 and 22 are pivotally mounted to the base or grip portion 24, and extend and pivot in a plane parallel to the grip portion 4, between the open position shown in FIG. 1 and the retracted position parallel to the grip portion as shown in FIGS. 4 and 5. Legs 20 and 22 are pivotally mounted to the grip portion 24 by any suitable means, such as a rivet 26 that passes through aligned holes in the legs 20 and 22 and grip portion 24. Friction between the legs 20 and 22 created by the rivet 26 releasably holds the legs 20 and 22 in either of the open and retracted positions. Other suitable means for releasably holding the legs in either of the retracted and open positions will be well apparent to those of ordinary skill in the art.

Figure 3:
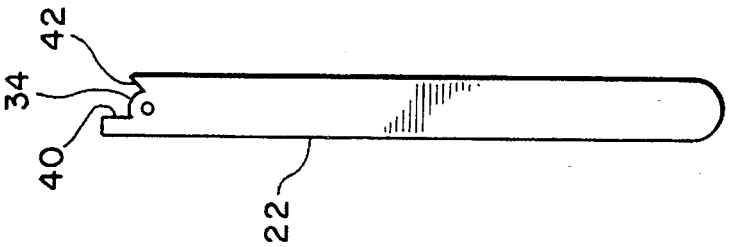
FIGS. 2 and 3 are front views of legs which are employed in the first embodiment.
Figure 2:
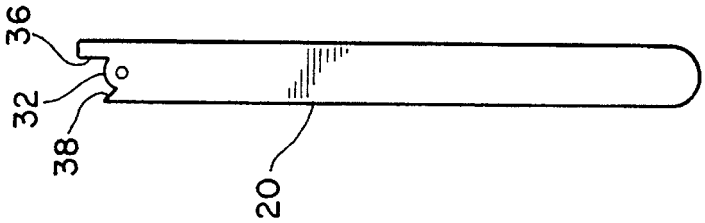

Projecting from a side 28 of the tubular wall 12, opposite the side 16 and an adjacent surface of the grip portion 24, is a stop element 30. The upper ends of the legs 20 and 22 have respective arched grooves 32 and 34 (see FIGS. 2 and 3). The groove 32 has at its opposite ends abutment surfaces 36 and 38. The groove 34 has at its ends abutment surfaces 40 and 42. The stop member 30 fits in the grooves 32 and 34 so that pivotal movements of the legs 20 and 22 are limited by abutment between the stop member 30 and the abutment surfaces 36, 38, 40 and 42. The arcs of grooves 32 and 34 each subtend approximately 45 degrees so that in the open position of the legs, the legs are approximately 90° apart as shown in FIG. 1, and in the closed position, the legs are aligned (0° apart).

To engage or disengage the golf club with respect to the stand, the stand is held in one hand in its closed position, gripping the upper portion of the legs and the grip portion 24 and the lower end of the golf club shaft is snapped into or out of the recess 14.

The legs 20 and 22 and the shaft engaging member 10 are formed of PVC plastic in the present embodiment although other materials such as a light weight metal are also suitable. To facilitate carrying of the golf stand in the golfer's pocket, the golf stand is small in size, for example, each leg may be about ⅝th inch wide, ¼ inch thick and 6 ¼ inches long (from bottom to pivot point), the tubular wall 12 may be ⅝ inch wide, ½ inch thick and 2 inches long and the grip portion 24 may be ⅝ inch wide, ¼ inch thick and 2 ¼ inches long, so that the overall stand has a tip-to-tip length of about 8 ¼ inches.

To further reduce the size of the stand for carrying, telescopic legs may be used instead of the legs 20 and 22. To additionally reduced the size and complexity of the golf club stand, one of the legs may be formed integrally with and as an extension of the club engaging member. Such an embodiment is illustrated in FIGS. 8 to 12.

The golf club stand 200 of this second embodiment has a shaft engaging member 202 which includes a generally tubular wall 204 with a slot or opening 206 in it. The opening 206 provides access to a generally U-shaped shaft receiving recess and thus permits wall 204 to be removably snap-connected to the shaft of a golf club, as in the first embodiment. The shaft engaging member also includes a neck portion 208 which is integrally connected to the wall 204.

The golf club stand 200 also includes an outer leg 210 which is integrally connected to the neck portion 208 of shaft engaging member 202. Leg 210 has first and second parallel walls 212 and a back wall 216 which connects the walls 12 and 214. The space between walls 212 and 214 provides a slot 218. Neck portion 208 has a cavity 220 which constitutes an extension of slot 218 for a short distance into shaft engaging member 202. Neck portion 208 additionally has holes (not shown) which are located so that a mounting member which extends through these holes, such as a screw 222, also extends through the cavity 220.

Figure 8:
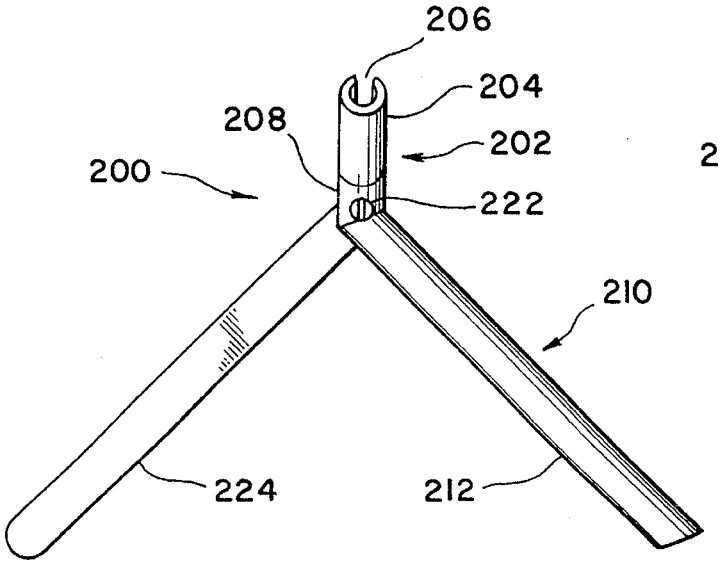
FIG. 8 is a front view of a second embodiment of the golf club stand of the invention in an open position.
Figure 9:
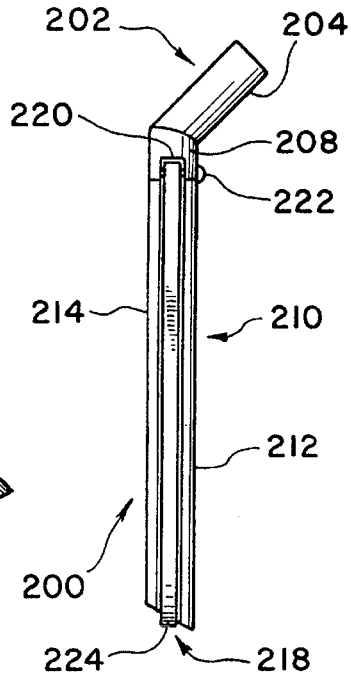
FIG. 9 is a left side view of the second embodiment in a closed position.
Figure 11:
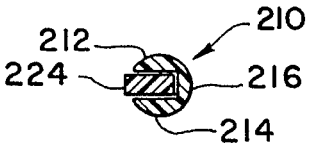
FIG. 11 is a cross-sectional view taken along line XI—XI in FIG. 10.
Figure 10:
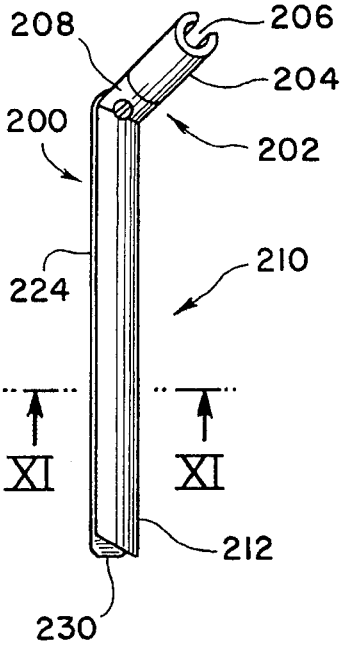
FIG. 10 is a front view of the second embodiment in the closed position.
Figure 12:
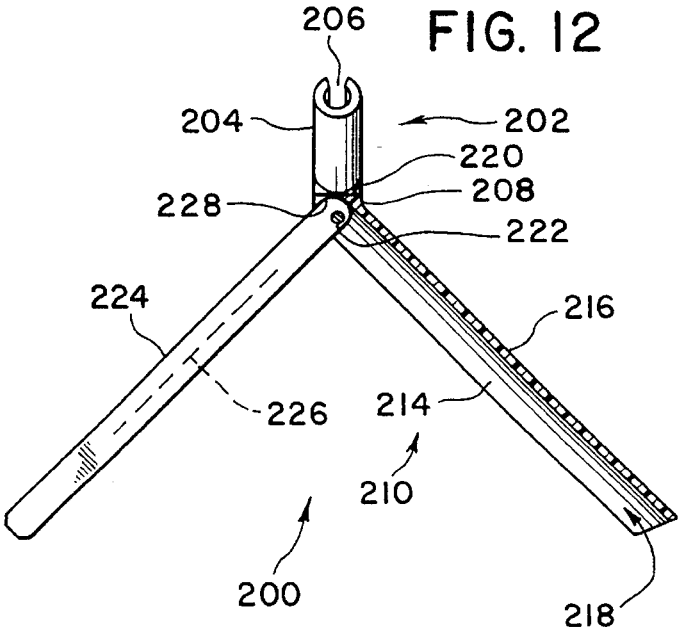
FIG. 12 is a front view of the second embodiment, partially in section.

An inner leg 224 has a hole (not numbered) through which the screw 222 extends so as to pivotally mount the inner leg 224 to the shaft engaging member 202. As will be seen from FIG. 12, the hole through which screw 222 extends is located near the upper end of inner leg 224, at a position that is offset with respect to the longitudinal axis 226 of inner leg 224. It will be apparent that inner leg 224 is pivotable between an open position as shown in FIGS. 8 and 12 and a retracted or closed position as shown in FIGS. 9 and 10. It its closed position, the inner leg 224 is folded into the slot 218 and retained therein by frictional engagement with sides 212 and 214. When inner leg 224 is in its open position, an abutment surface 228 near the upper end of inner leg 224 is lodged against the inner wall of cavity 220 to set a predetermined maximum angle (such as about 90 degrees) between legs 210 and 224. It is the offsetting of screw 222 with respect to the longitudinal axis 226 that permits the abutment surface 228 of leg 224 to rotate into engagement with the inner wall of cavity 220 for this purpose.

In FIG. 8, for example, neck portion 208, outer leg 210, and inner leg 224 are co-planar; that is, they are all parallel to the plane of the drawing. They remain co-planar, of course, when the legs 210 and 224 are in their closed position, and the legs together with neck portion 208 then form an elongated body which is slightly crooked at its upper end (due to neck portion 208) but which can nevertheless be easily slipped into a golfer's pocket. Tubular wall 204, on the other hand, extends upward in FIG. 8, at an angle of about 135 degrees with respect to the plane of the drawing.

The lower end of outer leg 210 is shaped so that a terminal portion 230 of inner leg 224 is exposed when the legs 210 and 224 are closed, as is best shown in FIG. 8. Since portion 230 is readily accessible the golfer can easily flick the legs to their open position.

Figure 13:
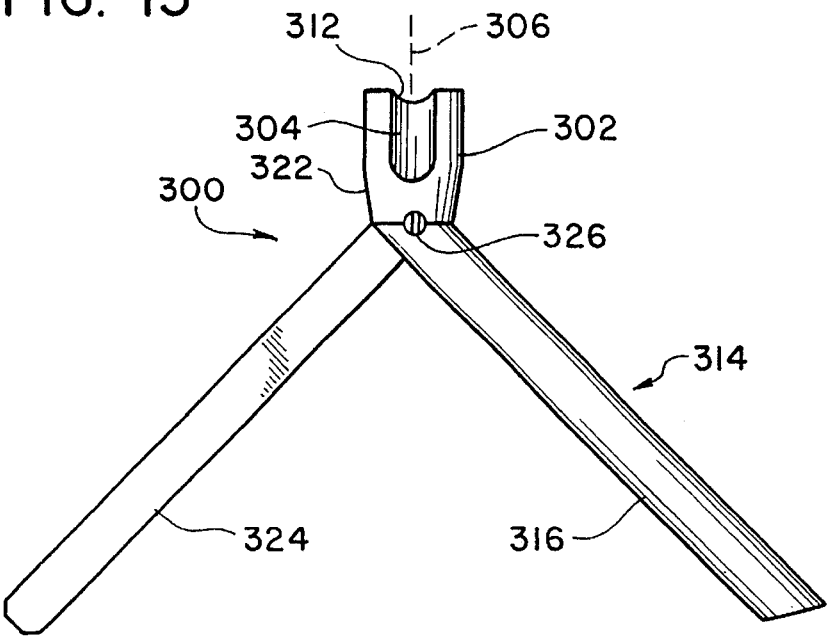
FIG. 13 is a front view of a third embodiment of the golf club stand of the invention in an open position.
Figure 14:
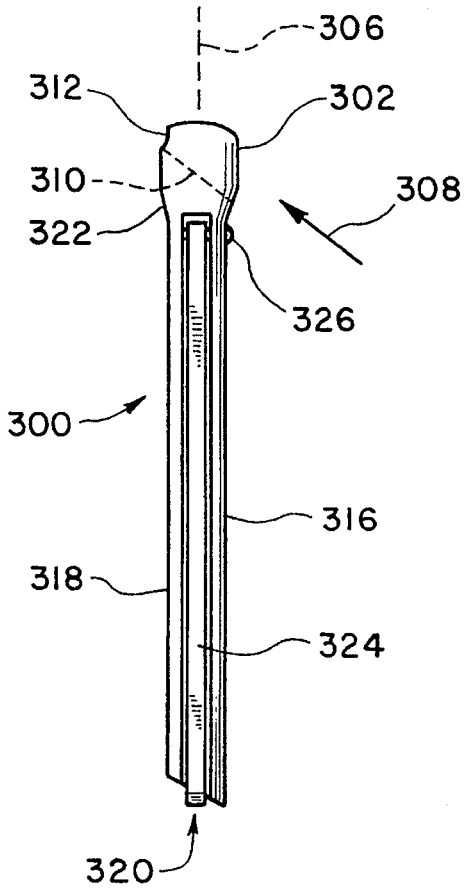
FIG. 14 is a left side view of the third embodiment in the closed position.

The golf club stand 300 shown in FIGS. 13 and 14 has a shaft engaging member 302 which is different from that of the prior embodiments. Instead of an elongated tubular member with a shaft receiving recess which extends in the direction of elongation of the tubular member, the shaft engaging member 302 in the present embodiment has a support portion with a shaft receiving recess 304 which extends in a direction that is transverse to the longitudinal axis 306 of shaft engaging member 302. The shaft engaging recess is generally U-shaped when seen in the direction of arrow 308 in FIG. 14. The bottom of the shaft receiving recess 304 follows a path marked by dotted line 310 in FIG. 14. This path slopes downward from a notch 312 at the upper end of shaft engaging member 302. A golf club shaft can be releasably snapped into the shaft receiving recess 304.

The golf club stand 300 has a leg structure very similar to that of golf club stand 200. That is, golf club stand 300 includes an outer leg 314 with first and second sides 316 and 318 and a back side (not numbered) connecting the first and second sides. The space between sides 316 and 318 provides a slot 320. The top end of outer leg 314 is integrally connected to a tapered neck portion 322 of shaft engaging member 302. The tapered neck portion 322 has a cavity (not numbered) which constitutes an extension of slot 320 for a short distance into shaft engaging member 302. An inner leg 324 is pivotably connected by a mounting member such as screw 326 which extends through a hole (not illustrated) in inner leg 324. This hole is located near the upper end of inner leg 324 at a position offset from the longitudinal axis (not numbered) of inner leg 324 so that an abutment surface near the upper end of inner leg 324 will rotate into engagement with an inner wall of slot 320 when inner leg 324 is moved to its open position. In its closed position, inner leg 324 folds into slot 320.

The longitudinal axis 306 of shaft engaging member 302 lies in the plane of legs 314 and 324, so that golf club stand 300 is compact and can easily be accommodated in a golfer's pocket.

It is to be understood that although the present invention has been described in detail with respect to preferred embodiments thereof, various other embodiments and variations which fall within the scope and spirit of the invention, will be apparent to those skilled in the art, the scope of the invention being limited only by the following claims. For example, in the embodiment of FIGS. 8–12, the neck portion 208 is provided to permit pivotal connection of the legs 224 without compromising the shaft receiving recess 206. However, it will be apparent to those skilled in the art that by suitable choice of materials and design, the length of the neck portion may be reduced further. In this way, the embodiment of FIGS. 8–12 may be collapsed substantially into a single plane, thereby to further improve the ease with which the stand may be carried in a pants pocket.

What is claimed is:

1. A golf club stand for supporting a golf club, the golf club having a golf club shaft and a golf club head at a lower end of the shaft, the golf club stand comprising:

a pair of legs, one being collapsible relative to the other, each having a lower ground engaging end and an upper end, and a golf club shaft engaging member connected to the upper ends of the pair of legs, the shaft engaging member being adapted for releasably engaging the golf club shaft, such that the golf club is held in a generally upright position with the golf club head and the lower ends of the pair of legs engaging the ground.

2. A golf club stand according to claim 1, wherein the legs are pivotally connected to each other at their upper ends so as to permit said legs to be collapsed into a compact state for carrying.

3. A golf club stand according to claim 1, wherein the shaft engaging member includes a support portion having a shaft receiving recess into which the lower end of the shaft of the club may be inserted.

4. A golf club stand according to claim 1, wherein the shaft engaging member includes a grip portion to which the legs are pivotally mounted to undergo angular movement.

5. A golf club stand according to claim 4, wherein the shaft engaging member further includes a stop element which is located adjacent to the upper ends of the legs, and wherein the upper ends of the legs have abutments which cooperate with the stop element to limit the angular movement of each leg.

6. A golf club stand according to claim 1, wherein the upper end of one of the legs is rigidly connected to the shaft engaging member.

7. A golf club according to claim 5, wherein the leg that is rigidly connected to the shaft engaging member has an elongated slot which receives the other leg of the par when the legs are collapsed.

8. A golf club stand according to claim 1, wherein the shaft engaging member includes a support portion and a neck portion integrally connected to the support portion, the support portion having a shaft receiving recess into which the lower end of the shaft of the golf club may be inserted, wherein the upper end of one of the legs is rigidly connected to the neck portion of the shaft engaging member, said one of the legs having an elongated slot and said neck portion having a cavity which is aligned with the slot so as to constitute an extension of the slot, the cavity having a cavity wall, wherein the other one of the legs has a longitudinal axis and a hole adjacent its upper end which is offset from the longitudinal axis, said other one of the legs additionally having an abutment surface adjacent its upper end, and wherein the golf club stand further comprises an elongated fastening member which is mounted on the neck portion and extends through the cavity therein, the fastening member additionally passing through the hole in said other one of the legs to mount said other one of the legs for pivotal movement between a closed position, wherein said other one of the legs is collapsed into the slot, and an open position, wherein the abutment surface on said other one of the legs is rotated into engagement with the cavity wall of the neck portion of the shaft engaging member.

9. A golf club stand according to claim 8, wherein the support portion of the shaft engaging member comprises a generally tubular wall having a shaft receiving recess and an opening which provides access to the shaft receiving recess, wherein both legs and the neck portion of the shaft engaging member lie in a common plane, and wherein the generally tubular wall extends in a direction which is transverse to the common plane.

10. A golf club stand according to claim 8, wherein the shaft engaging member and both legs have respective longitudinal axes that lie in a common plane, and wherein the shaft receiving recess follows a path that is transverse to the longitudinal axis of the shaft engaging member.

11. A golf club stand for supporting a golf club, comprising:

a collapsible pair of legs, each having a lower ground engaging end and an upper end, the legs being pivotally connected to each other at their upper end so as to permit said legs to be collapsed into a compact state for carrying, and a golf club shaft engaging member connected to the upper ends of the pair of legs, the shaft engaging member releasably engaging the golf club shaft, such that the golf club is held in a generally upright position with the head of the golf club and the lower ends of the pair of legs engaging the ground, the shaft engaging member including a support portion having a generally circular groove into which the lower end of the shaft of the club may be inserted, the shaft engaging member additionally including a grip portion to which the legs are pivotally mounted.

12. A golf club stand according to claim 11, further comprising a stop element connected to the support portion and the grip portion of the shaft engaging member, and wherein the legs have abutments at their upper ends which cooperate with the stop element to limit the pivoting of the legs.

13. A golf club stand for supporting a golf club, comprising:

an outer leg having an elongated slot therein, the outer leg having an upper end and a lower end;

an inner leg having an upper end and a lower end; and a golf club shaft engaging member which is rigidly connected to the upper end of the outer leg and pivotally connected to the upper end of the inner leg, the inner leg being movable between an open position and a closed position in which it is disposed within the slot, the shaft engaging member releasably engaging the golf club shaft, such that the golf club shaft is held in a generally upright position with the head of the golf club and the lower ends of the inner and outer legs on the ground when the inner leg is in its open position.

14. A golf club stand according to claim 13, wherein the inner leg has an abutment surface adjacent its upper end which rotates into contact with a wall of at least one of the shaft engaging member and the outer leg when the inner leg is moved to its open position.

15. A golf club stand according to claim 13, wherein the inner and outer legs lie in a common plane, and wherein the shaft engaging member comprises a generally tubular wall that extends in a direction transverse to the common plane, the generally tubular wall having a shaft receiving recess.

16. A golf club stand according to claim 13, wherein the inner and outer legs lie in a common plane, wherein the shaft engaging member has a longitudinal axis which also lies in the common plane, and wherein the shaft engaging member additionally has a shaft receiving recess which extends in a direction transverse to the longitudinal axis of the shaft engaging member.

* * * * *